US011953232B2

(12) United States Patent
Zhang et al.

(10) Patent No.: US 11,953,232 B2
(45) Date of Patent: Apr. 9, 2024

(54) MULTI-FLUE HEAT EXCHANGER ASSEMBLY WITH BAFFLE INSERT

(71) Applicant: Rheem Manufacturing Company, Atlanta, GA (US)

(72) Inventors: Qian Zhang, Montgomery, AL (US); Elmer Rodriguez, Tamalipas (MX); Oscar Rodriguez, Tamalipas (MX)

(73) Assignee: Rheem Manufacturing Company, Atlanta, GA (US)

( * ) Notice: Subject to any disclaimer, the term of this patent is extended or adjusted under 35 U.S.C. 154(b) by 117 days.

(21) Appl. No.: 17/141,571

(22) Filed: Jan. 5, 2021

(65) Prior Publication Data

US 2022/0214076 A1 Jul. 7, 2022

(51) Int. Cl.

| | |
|---|---|
| ***F24H 9/00*** | (2022.01) |
| ***F24H 7/00*** | (2022.01) |
| ***F28F 13/12*** | (2006.01) |

(52) U.S. Cl.

CPC ..... *F24H 9/0026* (2013.01); *F24H 7/005* (2013.01); *F24H 9/0031* (2013.01); *F28F 13/12* (2013.01); *F28F 2250/00* (2013.01)

(58) Field of Classification Search

CPC ..... F24H 7/005; F24H 9/0026; F24H 9/0031; F28F 13/12; F28F 2250/00

USPC ..... 122/18.31, 155.2

See application file for complete search history.

(56) References Cited

U.S. PATENT DOCUMENTS

| | | | | | |
|---|---|---|---|---|---|
| 2,558,971 | A * | 7/1951 | Lundstrum | F24H 1/205 | 122/18.31 |
| 2,826,220 | A * | 3/1958 | Young | F28F 13/12 | 138/38 |
| 3,769,959 | A * | 11/1973 | Parker | F28F 13/12 | 165/185 |
| 4,329,943 | A * | 5/1982 | Schworer | F24H 9/1836 | 122/33 |

(Continued)

FOREIGN PATENT DOCUMENTS

| | | | |
|---|---|---|---|
| CN | 102213436 | A | 10/2011 |
| SU | 1451533 | A2 | 1/1989 |
| WO | 2019030562 | A1 | 2/2019 |

OTHER PUBLICATIONS

International Search Report and Written Opinion issued in corresponding international application No. PCT/US2022/011263, dated Apr. 21, 2022, 7 pp.

*Primary Examiner* — Steven B McAllister
*Assistant Examiner* — Benjamin W Johnson
(74) *Attorney, Agent, or Firm* — Eversheds Sutherland (US) LLP

(57) ABSTRACT

The disclosed technology includes a heat exchanger assembly having a plurality of heat exchanger tubes. Each heat exchanger tube can include a baffle. The baffle can include a first end and a second end, a length of the baffle being defined as a distance between the first end and the second end, a body having a first side and a second side, a hanging portion located proximate the second end, and a plurality of fins disposed along the body. The plurality of fins can extend outwardly from the body and upwardly towards the second end at an angle relative to a central axis of the body. The plurality of fins can include a first fin positioned proximate the first end and having a first angle and a second fin (Continued)

positioned proximate the second end and having a second angle, the first angle being less than the second angle.

17 Claims, 10 Drawing Sheets

(56) References Cited

U.S. PATENT DOCUMENTS

| | | | | |
|---|---|---|---|---|
| 10,036,570 | B2 | 7/2018 | Zhang et al. | |
| 2001/0035135 | A1* | 11/2001 | Hughes | F24H 1/205 122/18.1 |
| 2009/0199788 | A1 | 8/2009 | Lesage | |

* cited by examiner

MULTI-FLUE HEAT EXCHANGER ASSEMBLY WITH BAFFLE INSERT

FIELD OF THE DISCLOSURE

The present invention relates generally to fuel-fired fluid heating devices, and more particularly, to a baffle for inserting into a heat exchanger tube of a fuel-fired heating device for improved heat transfer.

BACKGROUND

Traditional fuel-fired fluid heating devices can include a tank configured to store fluid and a combustion chamber positioned beneath the tank. A gas burner can be disposed within the combustion chamber. Combustion of fuel and air within the combustion chamber can provide a primary source of heat for the fluid within the tank. In order to dispose of hot combustion gases produced from the combustion of the fuel and air, traditional fuel-fired fluid heating devices can have a central flue pipe extending upwards from the combustion chamber through the tank and outwards from the housing around the tank. The hot combustion gases can flow upwardly through the flue pipe, thereby providing a secondary source of heat. However, this secondary source of heat can be relatively inefficient when the fuel-fired heating device is equipped with only a single, central flue pipe, as heat transfer from the hot combustion gases flowing upwardly through the central flue pipe to the fluid within the tank that is farthest from the central flue pipe can be minimal.

Additionally, the hot combustion gases can flow upwardly through the flue pipe in a natural laminar flow path. Without any form of interruption of the natural laminar flow path, the residence time of the hot combustion gases within the flue pipe can be relatively short. Accordingly, baffles and/or baffle arrangements can be inserted into a flue pipe to interrupt the natural laminar flow of the hot combustion gases, thereby providing an increase in residence time, and thus, improved heat transfer to fluid within the tank. However, some of the known baffles and/or baffle arrangements can require welding of individual parts which can undesirably add to the overall cost of the fuel-fired fluid heating devices and complicate manufacturing. Further, some of the known baffles and/or baffle arrangements can impose an undesirable high pressure drop across a height of the flue pipe, thereby potentially causing a dangerous buildup of carbon dioxide in the ambient environment surrounding the fuel-fired fluid heating device.

SUMMARY

These and other problems can be addressed by the technologies described herein. Examples of the present disclosure relate generally to a heat exchanger assembly including a plurality of heat exchanger tubes and a baffle for inserting into each heat exchanger tube.

The disclosed technology can include a heat exchanger tube having a baffle. The baffle can have a first end and a second end, a length of the baffle being defined as a distance between the first end and the second end; a body having a first side and a second side opposite the first side, the body having a first width; a hanging portion located proximate the second end, the hanging portion having a second width that is greater than the first width; and a plurality of fins disposed along the body. Each fin of the plurality of fins can extend outwardly from the body and upwardly towards the second end at an angle relative to a central axis of the body. A first fin of the plurality of fins can be positioned proximate the first end and can have a first angle. A second fin of the plurality of fins can be positioned proximate the second end and can have a second angle. The first angle can be less than the second angle.

Each fin of the plurality of fins can be spaced apart from an adjacent fin by a predetermined distance of between approximately 0.75 inches and approximately 1.25 inches.

Each fin of the plurality of fins can have a substantially semi-circular cross-section shape.

Each fin of the plurality of fins can have a substantially quarter-circular cross-section shape.

Each fin of the plurality of fins can have the same cross-section area and the same cross-section shape.

The angle at which each fin of the plurality of fins is disposed can progressively increase as the plurality of fins extend along the length of the baffle from the first fin to the second fin.

The angle at which the first fin can be between approximately 20 degrees and approximately 35 degrees and the second angle can be between approximately 50 degrees and approximately 65 degrees.

The plurality of fins can include a first portion and a second portion. The angle at which each fin of the first portion is disposed can be less than the angle at which each fin of the second portion is disposed, where the first portion can be proximate to the first end and the second portion can be proximate to the second end.

The plurality of fins can include a first portion, a second portion, and a third portion. The angle at which each fin of the first portion is disposed can be less than the angle at which each fin of the second portion and the third portion is disposed. The angle at which each fin of the third portion is disposed can be greater than the angle at which each fin of the first portion and the second portion is disposed. The first portion can be proximate to the first end, the second portion can be between the first portion and the third portion, and the third portion can be proximate to the second end.

The plurality of fins can include between approximately 6 and approximately 20 fins.

The disclosed technology can further include a fluid heating device including a tank having an inlet for delivering fluid into the tank and an outlet for outputting heated fluid from the tank; a combustion chamber in thermal communication with the tank, the combustion chamber having a burner disposed therein; and a heat exchanger assembly including a plurality of heat exchanger tubes. Each heat exchanger tube can be in fluid communication with the combustion chamber and extend through the tank. Each heat exchanger tube can include a baffle including a first end and a second end, a length of the baffle being defined as a distance between the first end and the second end; a body having a first side and a second side opposite the first side, the body having a first width; a hanging portion located proximate the second end, the hanging portion having a second width that is greater than the first width; and a plurality of fins disposed along the body. Each fin of the plurality of fins can extend outwardly from the body and upwardly towards the second end at an angle relative to a central axis of the body. A first fin of the plurality of fins can be positioned proximate the first end and can have a first angle. A second fin of the plurality of fins can be positioned proximate the second end and can have a second angle. The first angle can be less than the second angle.

The plurality of heat exchanger tubes can include between approximately 2 and approximately 20 heat exchanger tubes.

Each baffle can extend a majority of a length of each heat exchanger tube.

Each heat exchanger tube can have an inner diameter, the inner diameter being less than the second width of the hanging portion.

Each fin of the plurality of fins can have the same cross-section area and the same cross-section shape.

The angle at which each fin is disposed can progressively increase as the plurality of fins extend along the length of the baffle from the first fin to the second fin.

The first angle can be between approximately 20 degrees and approximately 35 degrees and the second angle can be between approximately 50 degrees and approximately 65 degrees.

The disclosed technology can further include a method of manufacturing a baffle for inserting into a heat exchanger tube. The method can include providing a sheet of metal having a first side and a second side and extending a length from a first end to a second end; penetrating the sheet of metal to form a plurality of fins disposed on at least a portion of the length; and bending each fin of the plurality of fins outward at an angle relative to a central axis of the sheet of metal.

Bending each fin of the plurality of fins outward at the angle relative to the central axis of the sheet of metal can include bending a first fin outwards from the first side of the sheet of metal and bending an adjacent fin outwards from the second side of the sheet of metal.

The method can further include bending a fin proximate to the first end of the sheet of metal at a first angle and bending a fin proximate the second end of the sheet of metal at a second angle, the first angle being less than the second angle.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1A:
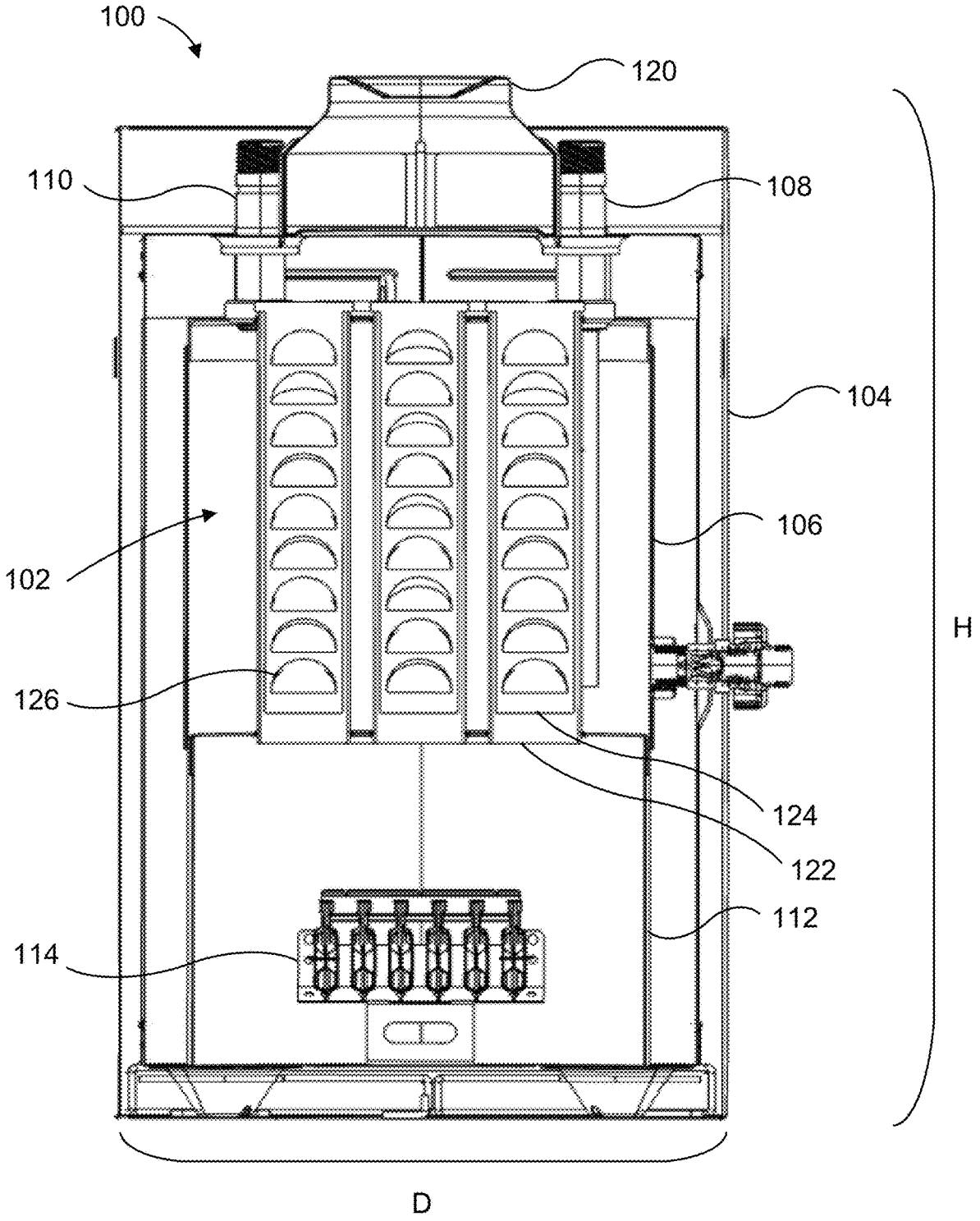
FIGS. 1A and 1B illustrate cross-sectional views of a fuel-fired fluid heating device including an example heat exchanger assembly, in accordance with the disclosed technology.

The disclosed technology includes a heat exchanger assembly having a plurality of heat exchanger tubes. One, some, or all of the heat exchanger tubes can include a baffle. The baffle can include a body having a first side and a second side opposite the first side. The baffle can include a plurality of fins disposed along the length of the baffle. Each fin can be disposed outwardly from each side of the baffle and upwardly at an angle relative to a central axis of the body. The angle at which each fin of the plurality of fins is disposed can progressively and/or incrementally increase as the plurality of fins extend along the length of the baffle. The plurality of fins can result in increased residence time of the hot combustion gases flowing through each heat exchanger tube as compared to heat exchanger assemblies in the prior art, thereby promoting efficient heat transfer and heating of the fluid in the tank.

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," "one example," "an example," "some examples," "certain examples," "various examples," etc., indicate that the embodiment(s) and/or example(s) of the disclosed technology so described may include a particular feature, structure, or characteristic, but not every embodiment necessarily includes the particular feature, structure, or characteristic. Further, repeated use of the phrase "in one embodiment" or the like does not necessarily refer to the same embodiment, example, or implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Unless otherwise specified, all ranges disclosed herein are inclusive of stated end points, as well as all intermediate values. By way of example, a range described as being "from approximately 2 to approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween. Further, the expression that a property "can be between approximately 2 and approximately 4" is also inclusive of the endpoints, meaning that the property can be approximately 2, can be approximately 4, or can be any value therebetween.

Unless otherwise specified, the terms liquid and/or water disclosed herein are inclusive of pure water ($H_2O$) and pure water plus any additives or additional component. Further, while the disclosed technology is referenced as be useful for water applications, it is to be understood that the disclosed technology can be used for any fluid, liquid, or otherwise.

Figure 1B:
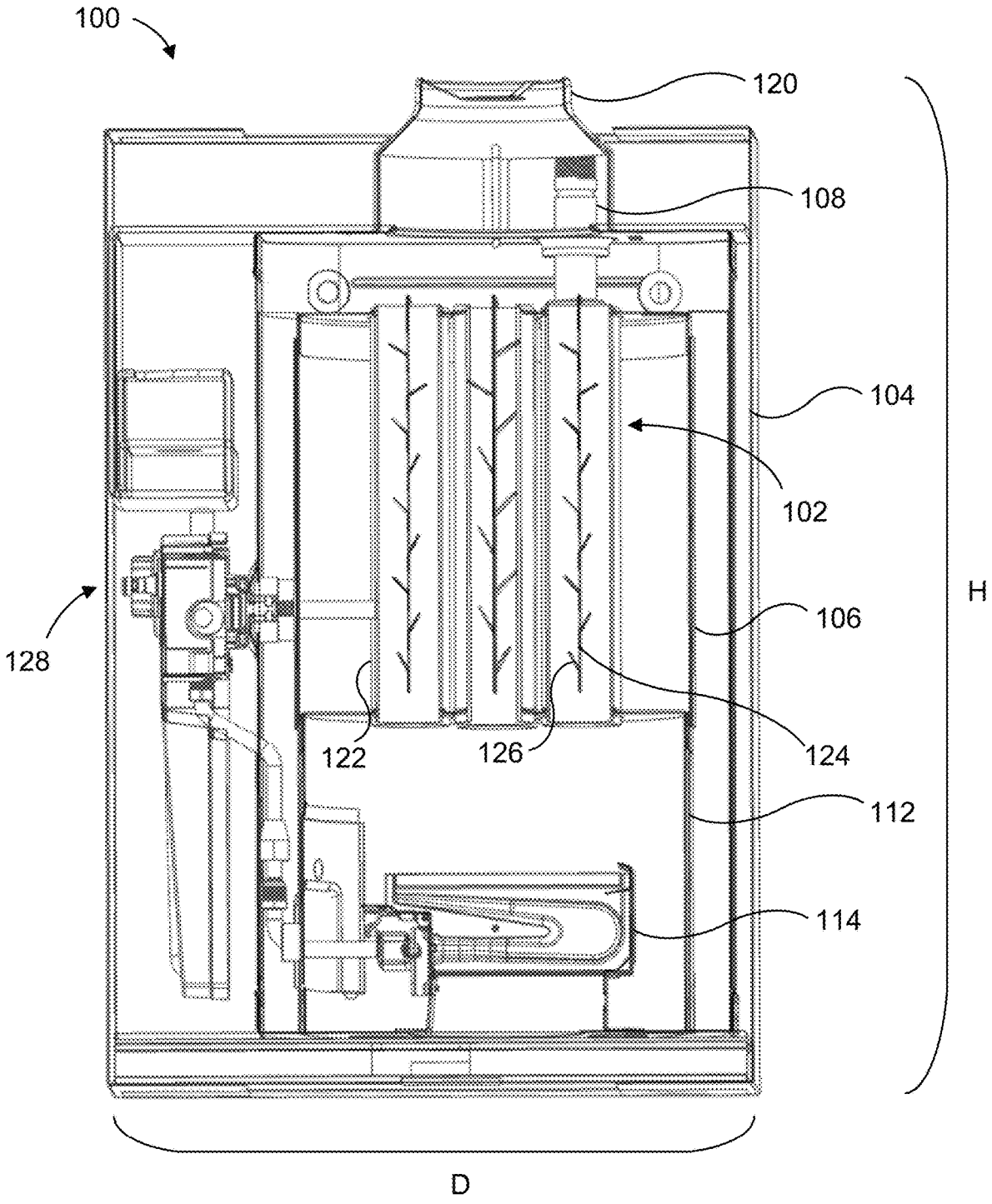

Referring now to the figures, FIGS. 1A and 1B illustrate cross-sectional views of a fluid heating device 100 having an example heat exchanger assembly 102, as further discussed herein. The fluid heating device 100 can be a fuel-fired fluid heating device. The fluid heating device 100 can include an outer shell 104. The outer shell 104 can include any insulating metal(s) or other material and can be any shape. By way of example, the outer shell 104 can be substantially cylindrical. The fluid heating device 100 can include a tank 106 enclosed within the outer shell 104. A layer of insulation can be disposed between the outer wall of the tank 106 and an inner wall of the outer shell 104. Optionally, the layer of insulation can include polyurethane foam. The tank 106 can have substantially the same shape as the outer shell 104. By way of example, the tank 106 can be substantially cylindrical. The tank 106 can be configured to hold a predefined quantity of water. By way of example, the tank 106 can be configured to hold between approximately 2.5 gallons and approximately 100 gallons of water. In one example, the tank 106 is configured to hold approximately 2.5 gallons of water. In another example, the tank 106 is configured to hold approximately 5 gallons of water. In configurations in which the tank 106 is configured to hold between approximately 2.5 gallons and approximately 5 gallons of water, the fluid heating device 100 can provide heated water substantially instantaneously. The tank 106 can include an inlet 108 and an outlet 110 configured to output heated water. The inlet 108 can extend through the outer shell 104 and open into the tank 106 to deliver unheated water. The outlet 110 can extend through the outer shell 104 from the tank 106 to output heated water. The inlet 108 and the outlet 110 can be tubular pipes with external fittings for connecting plumbing components to a typical pressurized home or commercial plumbing system.

The fluid heating device 100 can include a combustion chamber 112 enclosed within the outer shell 104. The combustion chamber 112 can be disposed below the tank 106. A burner 114 can be disposed within the combustion chamber 112. In one example, the burner 114 can include a main fuel-fired burner and a pilot burner. As illustrated in FIG. 1B, the burner 114 can be in communication with a gas control assembly 128. The gas control assembly 128 can be in communication with a gas control valve. The gas control valve can be configured to control the flow of gas to the burner 114 via a gas supply line (e.g., a natural gas or propane gas supply line) in response to the temperature of fluid within the tank 106 dropping below a predetermined threshold temperature. Combustion can occur upon the mixture of air and gas at the burner 114, thereby providing a primary means of heat transfer to the fluid within the tank 106.

The fluid heating device 100 can include the heat exchanger assembly 102 as further discussed herein. The heat exchanger assembly 102 can be in fluid communication with the combustion chamber 112. The heat exchanger assembly 102 can be in fluid communication with a vent 120. The heat exchanger assembly 102 can include a plurality of heat exchanger tubes 122 extending through the tank 106. Each heat exchanger tube 122 can have an open end at each end such that the heat exchanger tube 122 can be configured to direct the hot combustion gases from the combustion chamber 112, through the heat exchanger tube 122, and out of fluid heating device 100 via the vent 120.

One, some, or all of the heat exchanger tubes 122 can include a baffle 124 as further discussed herein. As illustrated in FIGS. 1A and 1B, the baffle 124 can extend substantially the length of the heat exchanger tube 122. The baffle 124 can include a plurality of fins 126 protruding outwardly from each lateral side of the baffle 124 and upwardly towards the open end of the heat exchanger tube 122 that is in fluid communication with the vent 120. The plurality of fins 126 can promote efficient heat transfer as the hot combustion gases flow upwardly through the heat exchanger tube 122 by increasing the residence time of the hot combustion gases flowing through the heat exchanger tubes 122.

The fluid heating device 100 can have any dimensions. The dimensions can vary depending on the quantity of water the tank 106 is configured to hold. By way of example, when the tank 106 is configured to hold approximately 2.5 gallons of water, the height H of the fluid heating device 100 can be between approximately 8 inches and approximately 12 inches. When the tank 106 is configured to hold approximately 5 gallons of water, the height H of the fluid heating device 100 can be between approximately 10 inches and approximately 14 inches. The diameter D of the fluid heating device 100 can similarly vary depending on the quantity of water the tank 106 is configured to hold. By way of example, when the tank 106 is configured to hold between approximately 2.5 gallons and approximately 5 gallons of water, the diameter D can be between approximately 8 inches and approximately 12 inches. Accordingly, the size of the fluid heating device 100 can be smaller compared to other traditional fluid heating devices. Such smaller size of the fluid heating device 100 can facilitate providing efficient heating of water.

Figure 2:
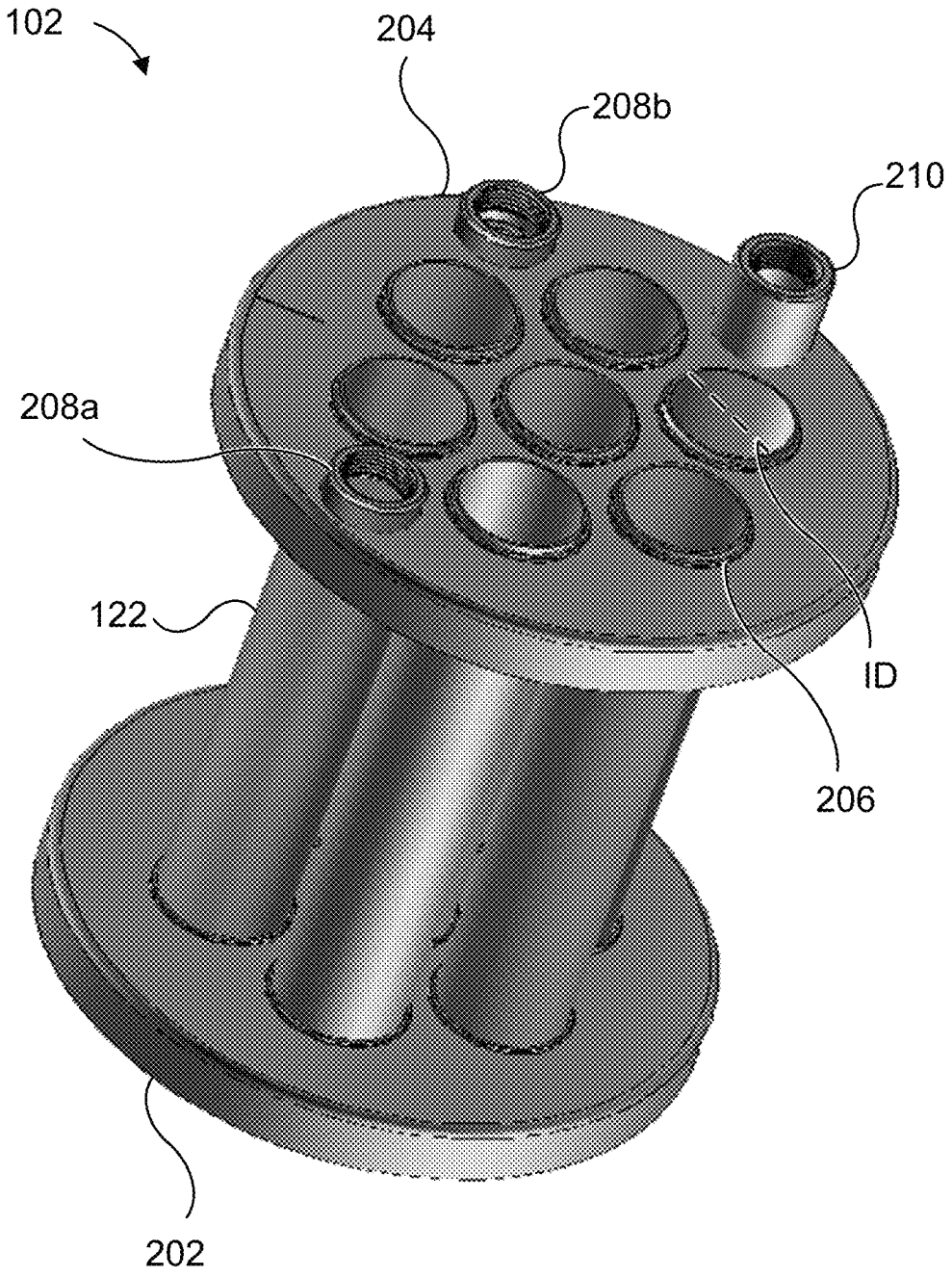
FIG. 2 illustrates an example heat exchanger assembly, in accordance with the disclosed technology.

FIG. 2 illustrates a perspective view of the heat exchanger assembly 102. The heat exchanger assembly 102 can include a first end 202 and a second end 204. The first end 202 and the second end 204 can be metal plates having substantially the same cross-section shape as the cross-section shape of the tank 106. By way of example, the first end 202 and the second end 204 can have a substantially disc shape, and thereby, a substantially circular cross-section. The first end 202 and the second end 204 can each include a plurality of apertures 206. Each aperture 206 can be configured to receive a heat exchanger tube 122. The first end 202 can be in fluid communication with the combustion chamber 112 while the second end 204 can be in fluid communication with the vent 120. In such configuration, the hot combustion gases can flow through the heat exchanger tubes 122 and be exhausted out of the fluid heating device 100 via the vent 120. The second end 204 can include one or more couplings 208*a*, 208*b* configured to receive fittings for the inlet 108 and outlet 110, respectively. The second end 204 can further include a coupling 210 configured to receive an anode. The anode can extend from the second end 204 into the water within the tank 106. The anode can provide cathodic protection to protect the tank 106 from corrosion, thereby extending the lifespan of the tank 106, and thus, the fluid heating device 100.

As illustrated in FIG. 2, the heat exchanger tubes 122 can be substantially tubular with open ends on each side. The heat exchanger tubes 122 can be made out of one or more thermally conductive metals to promote heat transfer as the hot combustion gases flow upwardly through the heat exchanger tubes 122 from the combustion chamber 112 to the exterior of the fluid heating device 100 via the vent 120. The heat exchanger tubes 122 can have any length. Optionally, the length of the heat exchanger tubes 122 can depend on the height H of the fluid heating device 100 and/or the size of the tank 106. The length of each heat exchanger tube 122 can be approximately a height of the tank 106. The length of the heat exchanger tube 122 can be slightly greater than the height of the tank 106. By way of example, the length of the heat exchanger tube 122 can be approximately 0.5 inches greater than the height of the tank 106. This excess length of the heat exchanger tube 122 can be approximately equally distributed between both ends of the heat exchanger tube 122 when inserted into the apertures 206 of the first end 202 and the respective apertures at the second end 204 of the heat exchanger assembly 102. In such a configuration, the heat exchanger tube 122 can be properly secured (e.g., via welding). Each heat exchanger tube 122 can have any size inner diameter ID. By way of example, each heat exchanger tube 122 can have an inner diameter ID of between approximately 0.5 inches and approximately 3 inches.

Figure 3A:
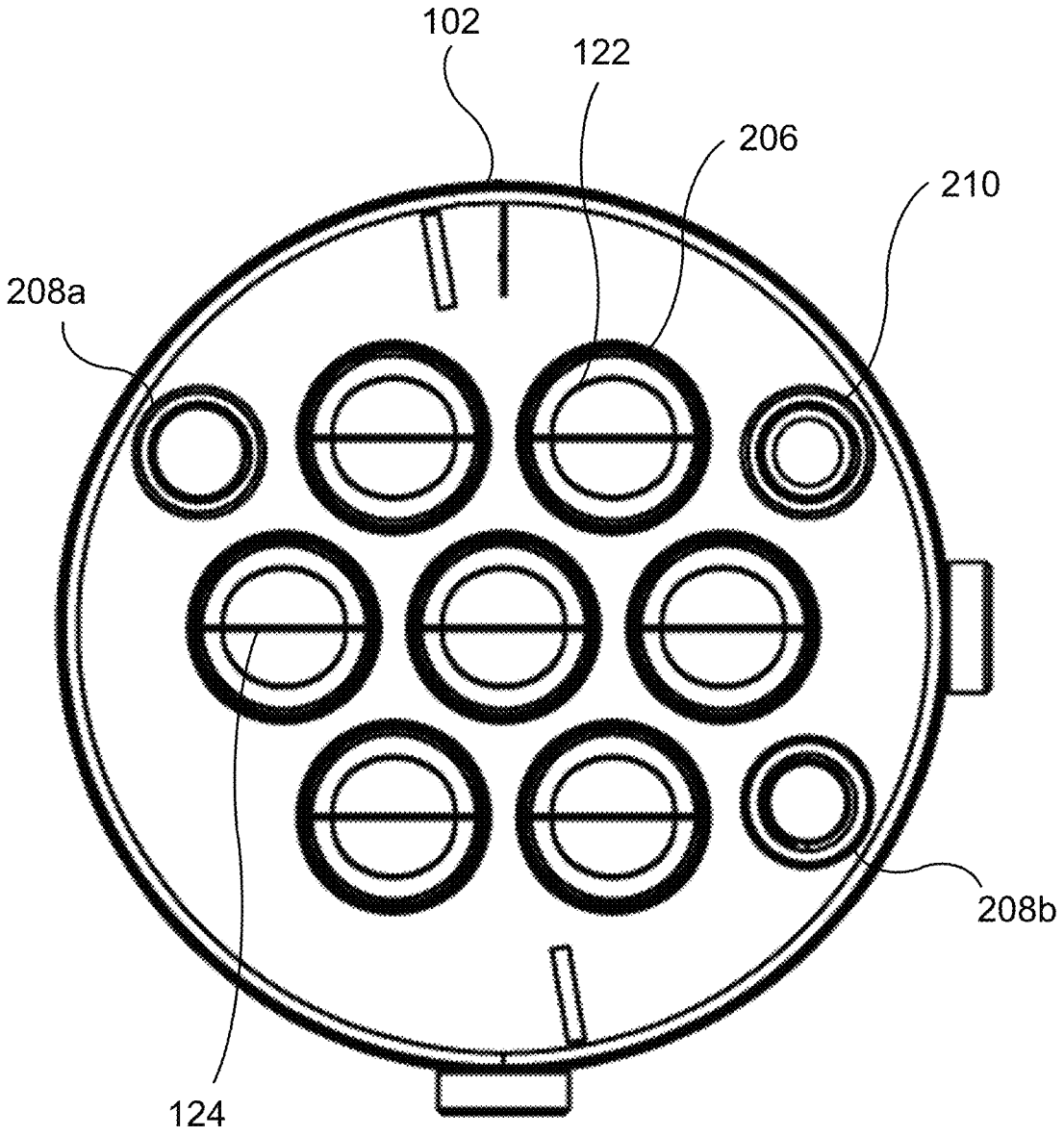
FIGS. 3A and 3B illustrate top views of example heat exchanger assemblies, in accordance with the disclosed technology.

FIG. 3A illustrates a top view of the heat exchanger assembly 102. The second end 204 of the heat exchanger assembly 102 can include seven apertures 206, each aperture 206 configured to receive a heat exchanger tube 122. The heat exchanger tubes 122 can be arranged in any pattern and/or configuration. By way of example, as illustrated in FIG. 3A, the heat exchanger tubes 122 can be arranged such that there is a central heat exchanger tube extending through a center of the tank 106 and the remaining tubes are arranged in a circular pattern around the central heat exchanger tube.

Figure 3B:
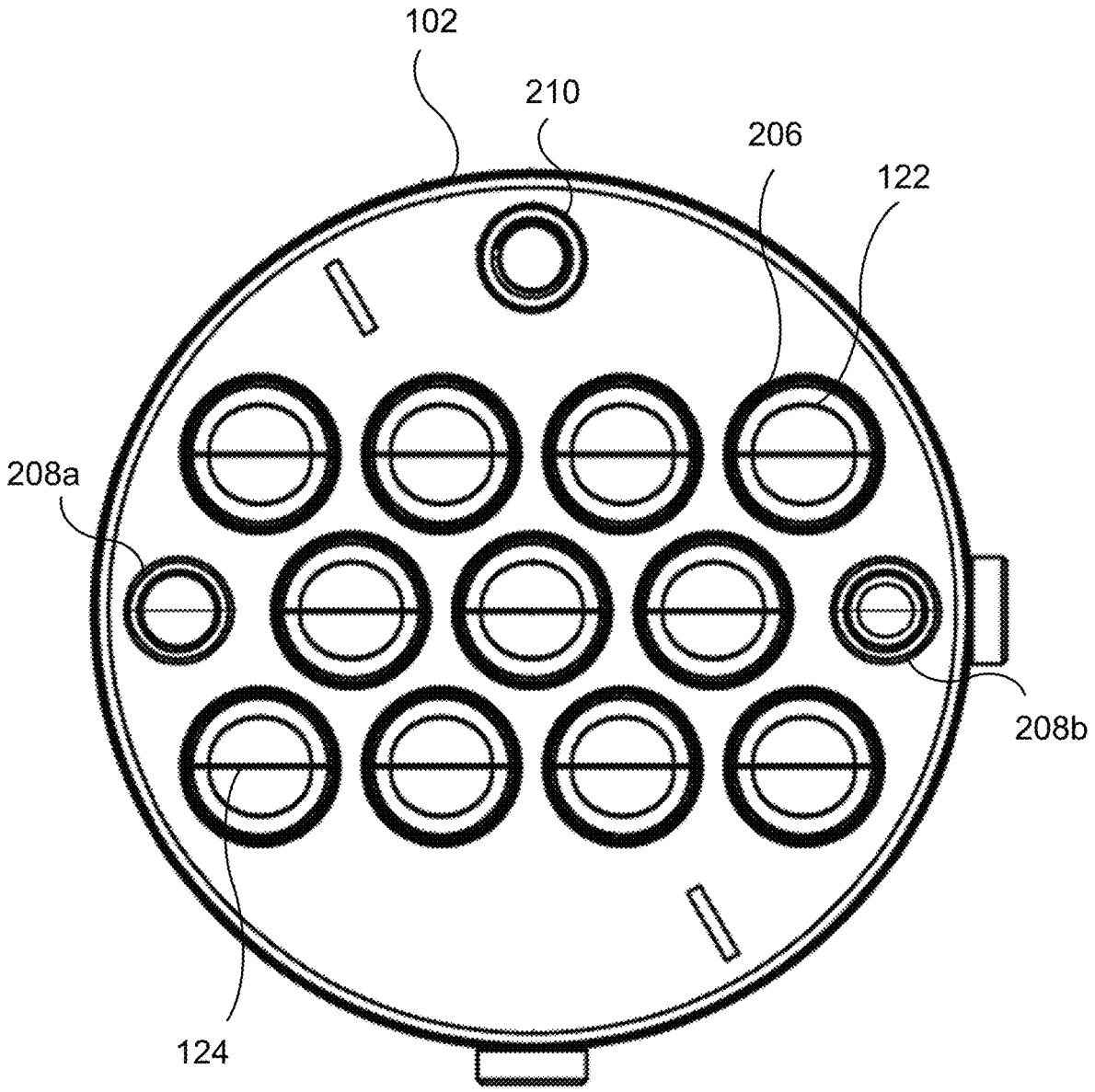

FIG. 3B illustrates a top view of an alternative heat exchanger assembly 102 having a different number of heat exchanger tubes 122 arranged in a different configuration as compared to the heat exchanger assembly illustrated in FIG. 3A. The heat exchanger tubes 122 can be arranged in one or more linear rows. As illustrated in FIG. 3B, the heat exchanger tubes 122 can be arranged in three linear rows, where the center row has three heat exchanger tubes 122 and the first row and the third row have four heat exchanger tubes 122.

Although FIGS. 2 through 3B illustrate various configurations of the heat exchanger tubes 122 of the heat exchanger assembly 102, it is contemplated that the heat exchanger assembly 102 can include any number of heat exchanger tubes 122 arranged in any configuration. By way of example, the heat exchanger assembly 102 can include between 2 and approximately 20 heat exchanger tubes 122. The number of heat exchanger tubes 122 can depend on the size of the tank 106. A tank 106 configured to hold a greater amount of fluid can have more heat exchanger tubes 122 than a tank 106 configured to hold less amount of fluid. By way of example, a tank 106 configured to hold approximately 5 gallons of fluid can include a greater number of heat exchanger tubes 122 than a tank 106 configured to hold 2.5 gallons of fluid. Additionally, the heat exchanger tubes 122 can be arranged in a substantially symmetrical pattern, as illustrated in FIGS. 2 through 3B. Alternatively, the heat exchanger tubes 122 can be randomly oriented.

The hot combustion gases flowing through the heat exchanger assembly 102 can provide an additional source of heat transfer to the fluid contained within the tank 106, apart from the primary source of heat transfer generated from the combustion itself. Because the heat exchanger assembly 102 includes the plurality of heat exchanger tubes 122 as compared to fuel-fired fluid heating devices in the prior art only including a single, central flue pipe, the heat exchanger assembly 102 can provide improved heat transfer, and thus, more efficient heating of the fluid within the tank 106. In particular, the plurality of heat exchanger tubes 122 provide a multitude of channels in which the hot combustion gases can flow such that a greater volume of fluid within the tank 106 can absorb heat from the hot combustion gases. Accordingly, the fluid within the tank 106 can become heated to the predetermined set temperature at a faster rate as compared to fuel-fired fluid heating devices in the prior art.

Figure 4A:
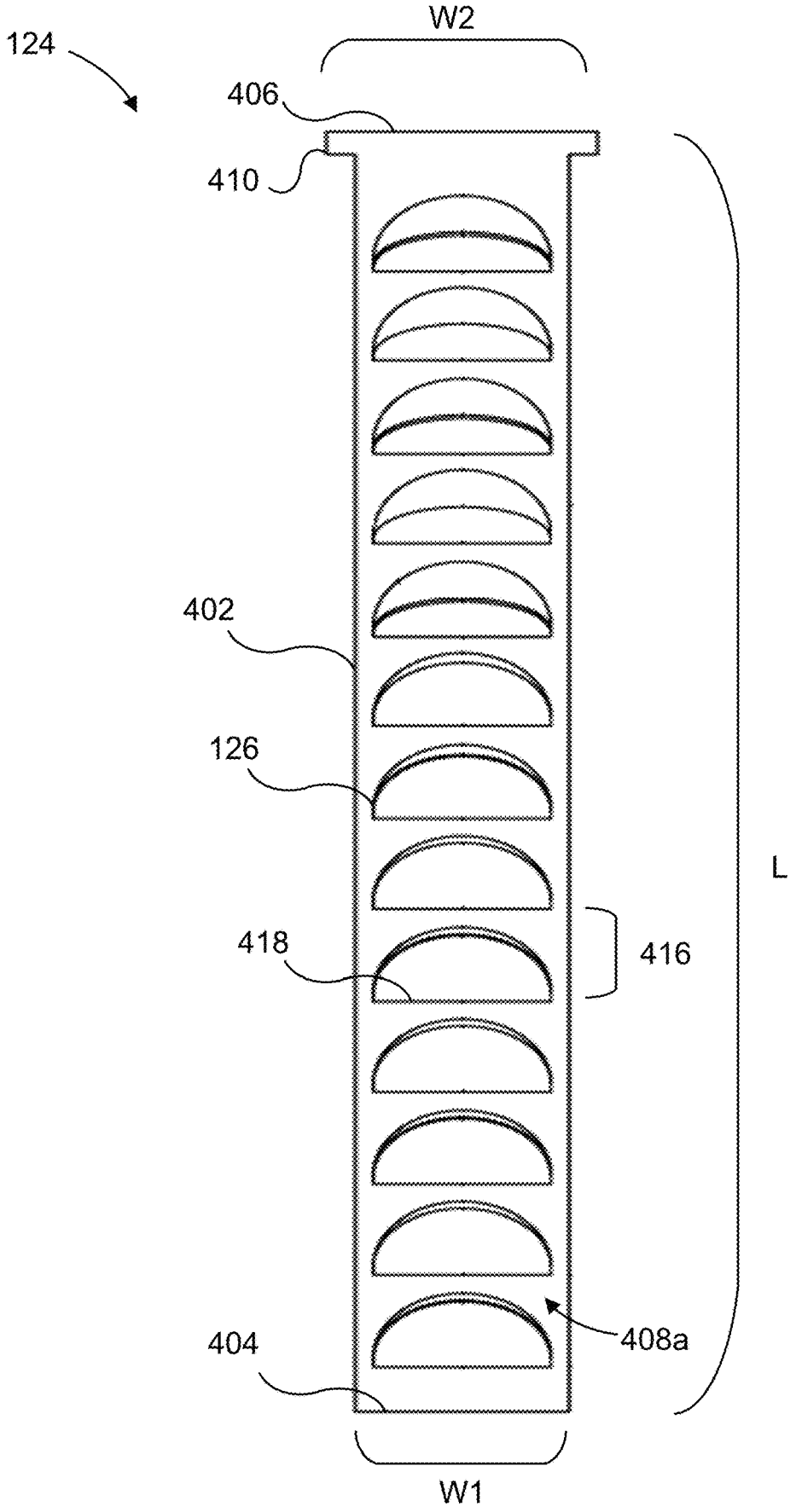
FIG. 4A illustrates a front view of an example baffle, in accordance with the disclosed technology.
Figure 4B:
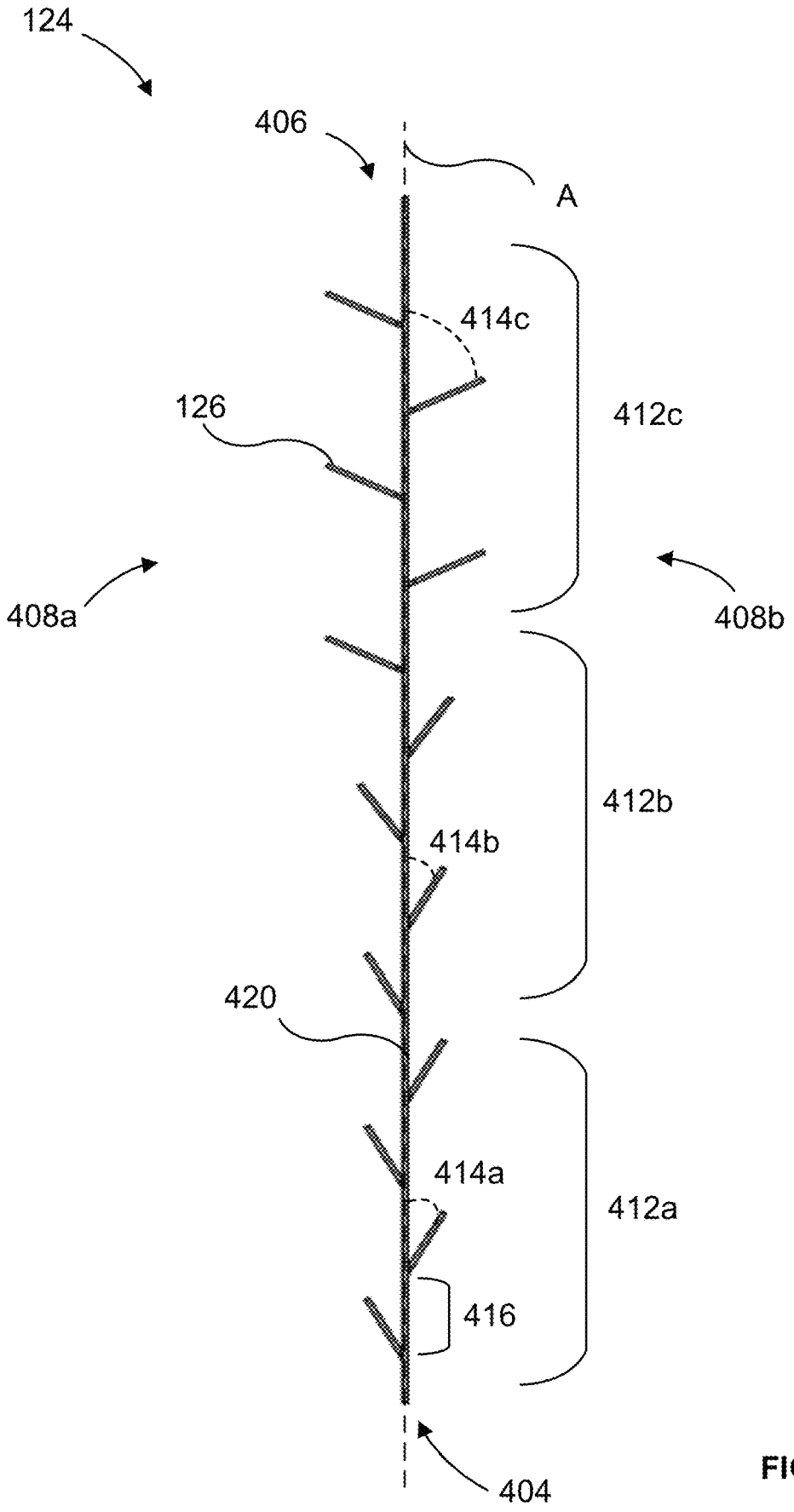
FIG. 4B illustrates a side view of an example baffle, in accordance with the disclosed technology.
Figure 4C:
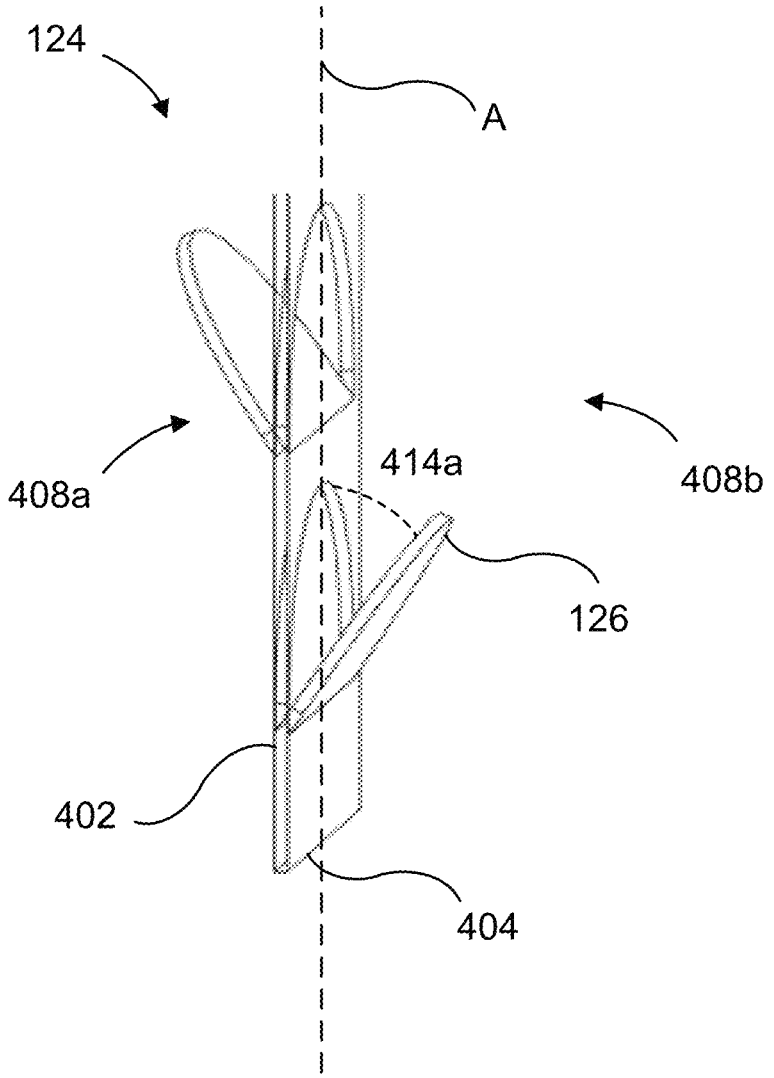
FIG. 4C illustrates a perspective view of a portion of an example baffle, in accordance with the disclosed technology.

FIGS. 4A-4C illustrate the example baffle 124 disposed within each heat exchanger tube 122 of the heat exchanger assembly 102. FIG. 4A illustrates a front view of the baffle 124, while FIG. 4B illustrates a side view of the baffle 124. FIG. 4C illustrates a perspective view of a portion of the baffle 124. Referring collectively to FIGS. 4A-4C, the baffle 124 can include a body 402 having two opposing lateral sides 408*a*, 408*b*. The body 402 can be a unitary sheet of metal(s) and can have any shape. Optionally, the body 402 can have a substantially rectangular cross-section. Optionally, the body 402 can have a substantially elongated ovular cross-section. The body 402 of the baffle 124 can have a width W1 of any size. By way of example, the body 402 can have a width W1 of between approximately 1 inch and 2 inches. The baffle can extend a length L from a first end 404 to a second end 406. The length L of the baffle 124 can be approximately equal to the length of the heat exchanger tube 122. Optionally, the length L of the baffle 124 can be only a portion of the length of the heat exchanger tube 122. By way of example, the length L of the baffle 124 can be approximately equal to half of the length of the heat exchanger tube 122. The first end 404 can extend proximate to the open end of the heat exchanger tube 122 that is in fluid communication with the combustion chamber 112. The second end 406 can extend proximate to the open end of the heat exchanger tube 122 that is in fluid communication with the vent 120. As illustrated in FIG. 4A, the second end 406 can be or include a hanging end 410. The hanging end 410 can include two protrusions extending in the width direction of the body such that the width W2 of the hanging end 410 is greater than the width W1 of the body 402. While the body 402 has a width W1 that is less than the inner diameter ID of the heat exchanger tube 122, the hanging end 410 of the baffle 124 has a width W2 (e.g., a diameter) that is greater than the inner diameter ID of the heat exchanger tube 122. Accordingly, when the body 402 of the baffle 124 is inserted into the heat exchanger tube 122, the protrusions of the hanging end 410 can abut a top surface at the mouth of the heat exchanger tube 122, thereby suspending the body 402 of the baffle 124 at a constant location and/or position within the heat exchanger tube 122.

The baffle 124 can include a plurality of fins 126. The plurality of fins 126 can extend along the length L of the baffle 124 and along each opposing lateral side 408*a*, 408*b* of the body 402. The plurality of fins 126 can extend outwardly from each lateral side 408*a*, 408*b* of the body 402 and upwardly toward the second end 406 at an angle 414 relative to a central axis A of the body 402. As illustrated in FIGS. 4B and 4C, the plurality of fins 126 can extend outwardly and upwardly toward the second end 406 in an alternating manner. In this configuration, a first fin can extend outwardly and upwardly from a first lateral side 408*a* and the adjacent fin (e.g., the fin positioned directly above and/or below the first fin) can extend outwardly and upwardly from a second lateral side 408*b*. Such configuration can allow the body 402 to include a greater number of fins 126 as compared to baffles in the prior art, as alternating the direction in which the adjacent fins extend outward can allow adjacent fins to be spaced relatively close together.

Each fin 126 can be spaced apart from each adjacent fin (e.g., the fin positioned directly above and/or below) by a predetermined distance 416. The predetermined distance 416 can be the distance from a base (e.g., straight edge) 418 of a first fin from the base 418 of an adjacent fin. By way of example, each fin 126 can be spaced apart from each adjacent fin by a predetermined distance 416 of between approximately 0.75 inches and approximately 1.25 inches. In one example, each fin 126 can be spaced apart from each adjacent fin by a predetermined distance 416 of approximately 1 inch. Each fin 126 can be spaced apart from each adjacent fin by the same predetermined distance 416. Alternatively, the fins 126 can be spaced apart from adjacent fins by varying predetermined distances 416.

The angle 414 at which each fin 126 is disposed can vary as the fins 126 extend along the length L of the baffle 124 from the first end 404 to the second end 406. The angle 414 can progressively and/or incrementally increase as the fins 126 extend from the first end 404 to the second end 406. In such configuration the fin located closest to the first end 404 can be positioned at the smallest angle while the fin located closest to the second end 406 can be positioned at the largest angle.

The plurality of fins 126 can be subdivided into a plurality of portions 412. The plurality of fins 126 can be subdivided into any number of portions 412, and each portion can include any number of fins 126 (e.g., one or more fins 126). As illustrated in FIG. 4B, the plurality of fins 126 can be subdivided into a first portion 412*a*, a second portion 412*b*, and a third portion 412*c*. The first portion 412*a* of the plurality of fins 126 can include fins 126 that are each positioned at a first angle 414*a* and are located proximate to the first end 404 of the body 402 (e.g., the first portion 412*a* of the plurality of fins 126 can be positioned at a lower portion of the body 402). The second portion 412*b* of the plurality of fins 126 can include fins 126 that are each positioned at a second angle 414*b* and are located between the first portion 412*a* and the third portion 412*c* (e.g., the second portion 412*b* of the plurality of fins 126 can be positioned at a center portion of the body 402). The third portion 412*c* of the plurality of fins 126 can include fins 126 that are each positioned at a third angle 414*c* and are located proximate the second end 406 of the body 402 (e.g., the third portion 412*c* of the plurality of fins 126 can be positioned at an upper portion of the body 402). The first portion 412*a*, the second portion 412*b*, and the third portion 412*c* can each include the same number of fins 126. As illustrated in FIG. 4B, each portion 412*a*, 412*b*, 412*c* of the plurality of fins 126 can include four fins 126. Alternatively, the first portion 412*a*, the second portion 412*b*, and the third portion 412*c* can each include a different number of fins 126. The first angle 414*a* can be smaller than the second angle 414*b*, and the second angle 414*b* can be smaller than the third angle 414*c*, such that the angle 414 can incrementally increase as the fins 126 extend along the length of the body 402 from the first end 404 to the second end 406. The angle 414 can be any angle less than 90 degrees and greater than 0 degrees. Optionally, the angle 414 of the fin and/or fins 126 proximate the first end 404 can be between approximately 20 degrees and approximately 35 degrees, and the angle 414 of the fin and/or fins 126 proximate the second end 406 can be between approximately 50 degrees and approximately 65 degrees. As a nonlimiting example, the first angle 414*a* can be approximately 25 degrees, the second angle 414*b* can be between approximately 30 degrees with respect to the body 402, and the third angle 414*c* can be approximately 60 degrees with respect to the body 402.

Alternatively, the angle 414 at which each fin of the plurality of fins 126 is disposed can progressively increase as the plurality of fins 126 extend along the body 402 from the first end 404 to the second end 406, such that each angle 414 is different. In such configuration, the fin 126 closest to the first end 404 can be positioned at the smallest angle, and the fin 126 closest to the second end 406 can be positioned at the largest angle, and the fins 126 positioned between such fins 126 can be disposed at a gradually increasing angle 414. By way of example, the fin closest to the first end 404 can be positioned at an angle 414 of between approximately 25 degrees and approximately 35 degrees and the fin 126 closest to the second end 406 can be positioned at an angle 414 of between approximately 50 degrees and approximately 65 degrees. The fins 126 disposed between the fin closest the first end and the fin closest the second end can each be positioned at an angle 414 such that the angle 414 progressively increases as the fins extend from the first end 404 to the second end 406. Optionally, the angle 414 at which each fin is disposed on the body 402 can progressively increase by between approximately 2 degrees and approximately 5 degrees as the fins 126 extend from the first end 404 to the second end 406.

By progressively increasing and/or incrementally increasing the angle 414 at which the plurality of fins 126 are disposed on the body 402, the baffle 124 can include a greater number of fins 126 as compared to baffles in the prior art, as the predetermined distance 416 between adjacent fins can be smaller than if each fin was positioned at the same angle. Additionally, by progressively increasing and/or incrementally increasing the angle 414 at which the plurality of fins 126 are disposed on the body 402, excess restriction in the flow of the hot combustion gases can be minimized, thereby reducing the buildup of carbon dioxide and/or carbon monoxide.

Figure 5A:
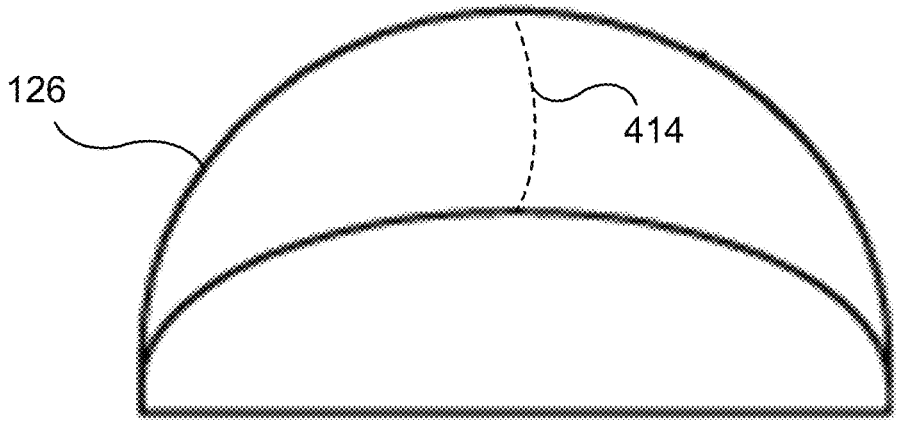
FIGS. 5A-5C illustrate various design configurations of a fin, in accordance with the disclosed technology.
Figure 5B:
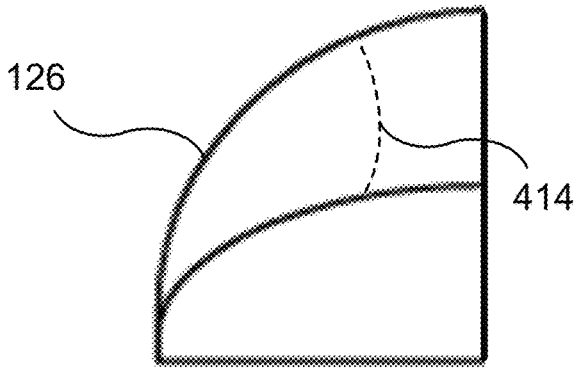
Figure 5C:
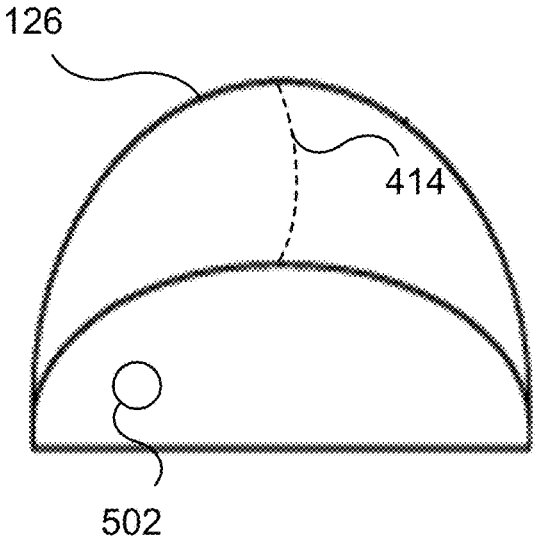

As illustrated in FIGS. 4A-4C, each fin 126 can have substantially the same cross-section area and cross-section shape. The cross-section area of each fin 126 and/or the angle 412 at which each fin 124 is bent can be sized relative to the inner diameter ID of the heat exchanger tube 122 such that there is a minimum sized gap between the outer edge of the fin 126 and the inner wall of the heat exchanger tube 122. By way of example, the gap between the outer edge of the fin 126 and the inner wall of the heat exchanger tube 122 can be approximately ⅛ inch, ¼ inch, or ½ inch. The cross-section shape can be any shape. As illustrated in FIG. 5A, each fin 126 can have a cross-section shape that is a substantially half-circle. Optionally, as illustrated in FIG. 5B, each fin 126 can have a cross-section shape that is a substantially quarter-circle. Although FIGS. 5A and 5B illustrate example cross-section shapes of the fins 126, it is contemplated that the cross-section shape can also be substantially rectangular, ovular, triangular, and/or polygonal. Optionally, the cross-section shape of the fins 126 can be irregular (e.g., the fin 126 can include a wavy, corrugated, and/or zig-zag configuration for at least one side). Optionally, as illustrated in FIG. 5C, one or more of the fins 126 can include one or more apertures 502. The one or more apertures 502 can be disposed at any location on the fin 126 and can serve to further disrupt the natural laminar flow of the hot combustion gases flowing through the heat exchanger tube 122.

The baffle 124 can promote efficient heat transfer, and thereby, efficient heating of fluid within the tank 106. The plurality of fins 126 can increase residence time of the hot combustion gases flowing through each heat exchanger tube 122 as compared to heat exchanger tubes without a baffle and/or heat exchanger tubes with baffles known in the prior art. Accordingly, the hot combustion gases can remain in the heat exchanger tube for a greater amount of time as compared to fluid heating devices and/or heat exchangers in the prior art, allowing for heat transfer to be improved. The angle 414 at which each fin of the plurality of fins 126 is disposed and the cross-section shape and cross-section area of each fin 126 can be selectively determined to control pressure drop within the hot combustion gases over the length of each heat exchanger tube 122 so that the increased residence time of the hot combustion gases within each heat exchanger tube 122 and the enhanced heat transfer is not at the disadvantage of impeded exhaust flow. Accordingly, heat loss, which commonly occurs in conventional fluid heating devices when in stand-by mode (e.g., when holding a contained amount of fluid in the tank at a predetermined set temperature) can be minimized. Additionally, the angle 414 at which each fin of the plurality of fins 126 is disposed and the cross-section shape and cross-section area of each fin 126 can be selectively determined to ensure the plurality of fins 126 do not impede the natural laminar flow of the hot combustion to an extent that the production of carbon monoxide and carbon dioxide emissions is undesirable.

Figure 6:
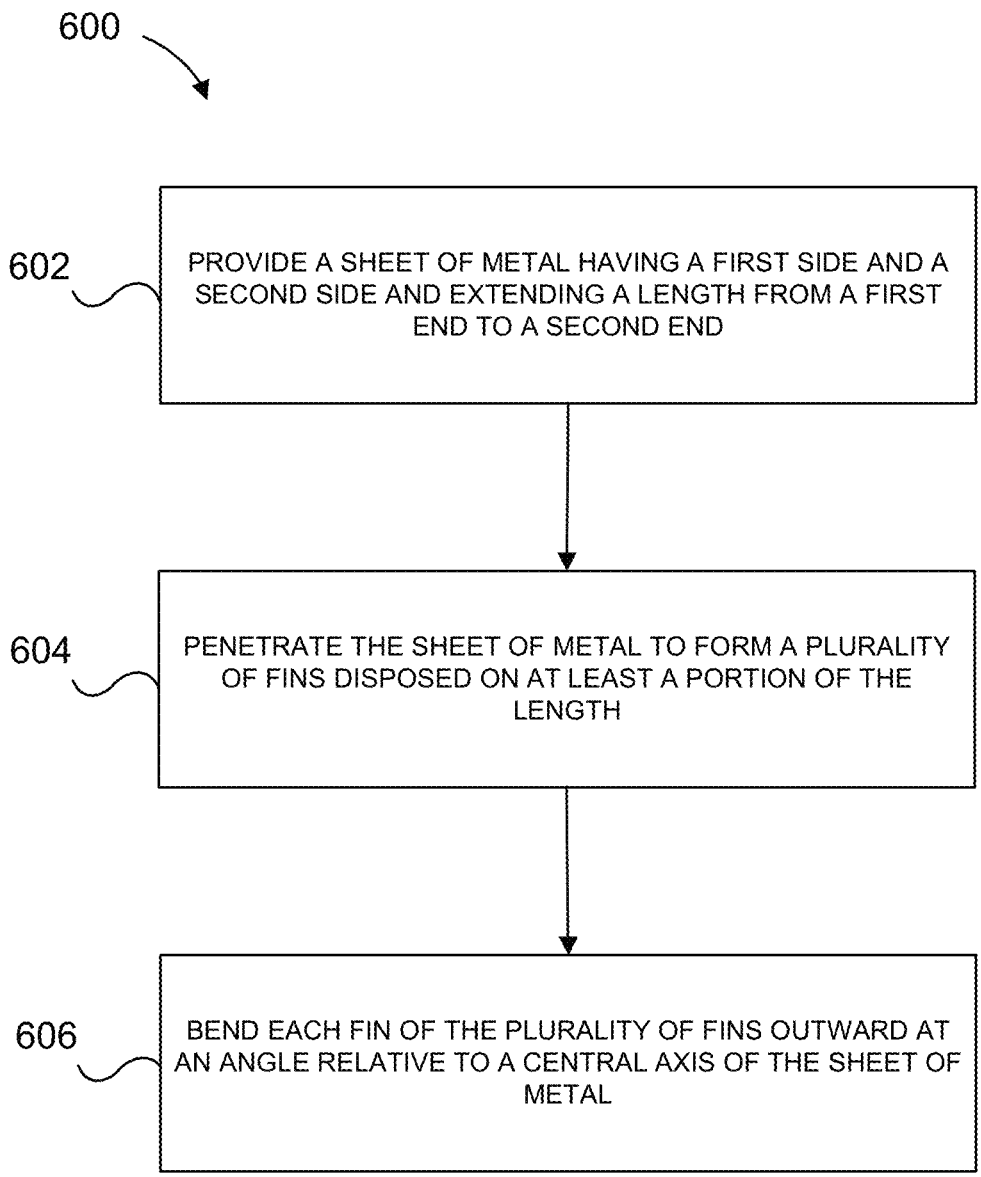
FIG. 6 is a flow diagram outlining an example method of manufacturing an example baffle, in accordance with the disclosed technology.

FIG. 6 is a flow diagram outlining a method 600 of manufacturing an example baffle 124. The method 600 can include providing 602 a sheet of metal (e.g., the body 402) having a first side 408*a* and a second side 408*b* and extending a length L from a first end 404 to a second end 406. The sheet of metal can include stainless steel, carbon steel, aluminized steel, or any other suitable sheet metal adapted for puncturing, cutting, stamping, and/or bending. Optionally, the second end 406 of the sheet of metal can include a hanging end 410 that extends past the width of the sheet of metal.

The method 600 can include penetrating 604 the sheet of metal to form a plurality of fins 126 disposed on at least a portion of the length L of the sheet of metal. Any tool capable of puncturing, cutting, stamping, and/or the like can be used to penetrate the sheet of metal. By way of example, a laser cutting tool can be used to create a cut having a substantially arc shape.

The method 600 can include bending 606 each fin of the plurality of fins 126 at an angle 414 relative to the central axis A of the sheet of metal such that the fins 126 point generally upwards towards the second end 406 of the sheet of metal. A first fin can be bent outwards from the first side 408*a* of the sheet of metal and an adjacent fin can be bent outwards from the second side 408*b* of the sheet of metal. In such configuration, the plurality of fins can be bent outwards in an alternating manner. The fin proximate to the first end 404 of the sheet of metal can be bent outwards at a first angle and the fin proximate to the second end 406 of the sheet of metal can be bent outwards at a second angle. The first angle can be less than the second angle. By way of example, the first angle can be between approximately 20 degrees and 35 degrees and the second angle can be between approximately 50 degrees and approximately 65 degrees. The fins disposed between the fin proximate to the first end 404 and the fin proximate to the second end 406 can be bent at an angle 414 that progressively and/or incrementally increases as the plurality of fins 126 extend along the length of the sheet of metal from the first end 404 to the second end 406.

By manufacturing the baffle 124 using a single sheet of metal, welding of the fins 126 and/or other components of the baffle can be avoided, and thus, the costs associated therewith can also be avoided. This can allow the manufacturing of the baffle 124 to be relatively easy and cost-effective as compared to other known baffles in the prior art. The cost of manufacturing the baffle 124 can be approximately 50% lower as compared to the cost of manufacturing other known baffles known in the prior art. Additionally, the weight of the baffle 124 can be minimized due to creating the fins by penetrating (e.g., puncturing, stamping, laser cutting, and the like) the sheet of the metal.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

What is claimed is:

1. A plurality of heat exchanger tubes for use with a water heating device, each heat exchanger tube having a baffle comprising:

a first end and a second end, a length of the baffle being defined as a distance between the first end and the second end;

a body having a first side and a second side opposite the first side, the body having a first width;

a hanging portion located proximate the second end, the hanging portion having a second width that is greater than the first width; and a plurality of fins disposed along the body, each fin of the plurality of fins extending outwardly from the body and upwardly towards the second end at an angle relative to a central axis of the body, wherein (i) a first fin of the plurality of fins is positioned proximate the first end and has a first angle and (ii) a second fin of the plurality of fins is positioned proximate the second end and has a second angle, the first angle being less than the second angle;

wherein the plurality of heat exchanger tubes are arranged in a pattern distributed within a tank of the water heating device; and wherein an orientation of each baffle within each respective heat exchanger tube is alternated relative to an orientation of a baffle of an adjacent heat exchanger tube.

2. The plurality of heat exchanger tubes of claim 1, wherein each fin of the plurality of fins is spaced apart from an adjacent fin by a predetermined distance of between approximately 0.75 inches and approximately 1.25 inches.

3. The plurality of heat exchanger tubes of claim 1, wherein each fin of the plurality of fins has a substantially semi-circular cross-section shape.

4. The plurality of heat exchanger tubes of claim 1, wherein each fin of the plurality of fins has a substantially quarter-circular cross-section shape.

5. The plurality of heat exchanger tubes of claim 1, wherein each fin of the plurality of fins has the same cross-section area and the same cross-section shape.

6. The plurality of heat exchanger tubes of claim 1, wherein the angle at which each fin of the plurality of fins is disposed progressively increases as the plurality of fins extend along the length of the baffle from the first fin to the second fin.

7. The plurality of heat exchanger tubes of claim 1, wherein the first angle is between approximately 20 degrees and approximately 35 degrees and the second angle is between approximately 50 degrees and approximately 65 degrees.

8. The plurality of heat exchanger tubes of claim 1, wherein the plurality of fins includes a first portion and a second portion, the angle at which each fin of the first portion is disposed being less than the angle at which each fin of the second portion is disposed, the first portion being proximate to the first end and the second portion being proximate to the second end.

9. The plurality of heat exchanger tubes of claim 1, wherein the plurality of fins includes a first portion, a second portion, and a third portion, the angle at which each fin of the first portion is disposed being less than the angle at which each fin of the second portion and the third portion is disposed and the angle at which each fin of the third portion is disposed being greater than the angle at which each fin of the first portion and the second portion is disposed, wherein the first portion is proximate to the first end, the second portion is between the first portion and the third portion, and the third portion is proximate to the second end.

10. The plurality of heat exchanger tubes of claim 1, wherein the plurality of fins includes between approximately 6 and approximately 20 fins.

11. A water heating device comprising:

a tank having an inlet for delivering water into the tank and an outlet for outputting heated water from the tank;

a combustion chamber in thermal communication with the tank, the combustion chamber having a single burner disposed therein; and a heat exchanger assembly including a plurality of heat exchanger tubes, each heat exchanger tube being in fluid communication with the combustion chamber, each heat exchanger tube including a baffle comprising:

a first end and a second end, a length of the baffle being defined as a distance between the first end and the second end;

a body having a first side and a second side opposite the first side, the body having a first width;

a hanging portion located proximate the second end, the hanging portion having a second width that is greater than the first width; and a plurality of fins disposed along the body, each fin of the plurality of fins extending outwardly from the body and upwardly towards the second end at an angle relative to a central axis of the body, wherein (i) a first fin of the plurality of fins is positioned proximate the first end and has a first angle and (ii) a second fin of the plurality of fins is positioned proximate the second end and has a second angle, the first angle being less than the second angle;

wherein a central heat exchanger tube is disposed along a central axis of the tank, and wherein the remaining plurality of heat exchanger tubes are arranged in a pattern within the tank around the central heat exchanger tube; and wherein an orientation of each baffle within each respective heat exchanger tube is alternated relative to an orientation of a baffle of an adjacent heat exchanger tube.

12. The water heating device of claim 11, wherein the plurality of heat exchanger tubes includes between approximately 2 and approximately 20 heat exchanger tubes.

13. The water heating device of claim 11, wherein each baffle extends a majority of a length of each heat exchanger tube.

14. The water heating device of claim 11, wherein each heat exchanger tube has an inner diameter, the inner diameter being less than the second width of the hanging portion.

15. The water heating device of claim 11, wherein each fin of the plurality of fins has the same cross-section area and the same cross-section shape.

16. The water heating device of claim 11, wherein the angle at which each fin of the plurality of fins is disposed progressively increases as the plurality of fins extend along the length of the baffle from the first fin to the second fin.

17. The water heating device of claim 11, wherein the first angle is between approximately 20 degrees and approximately 35 degrees and the second angle is between approximately 50 degrees and approximately 65 degrees.

* * * * *